US007712331B2

(12) United States Patent
Dee et al.

(10) Patent No.: US 7,712,331 B2
(45) Date of Patent: May 11, 2010

(54) SYSTEM TO INCREASE CAPACITY OF LNG-BASED LIQUEFIER IN AIR SEPARATION PROCESS

(75) Inventors: Douglas Paul Dee, Orefield, PA (US); Jung Soo Choe, Gwynedd Valley, PA (US); Donn Michael Herron, Fogelsville, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 153 days.

(21) Appl. No.: 11/477,924

(22) Filed: Jun. 30, 2006

(65) Prior Publication Data

US 2008/0000266 A1 Jan. 3, 2008

(51) Int. Cl.
*F25J 1/00* (2006.01)
*F25J 3/00* (2006.01)
*F17C 9/02* (2006.01)

(52) U.S. Cl. ..... 62/612; 62/643; 62/50.2

(58) Field of Classification Search ..... 62/643, 62/50.2, 646

See application file for complete search history.

(56) References Cited

U.S. PATENT DOCUMENTS 3,886,758 A 6/1975 Perrotin et al
5,137,558 A 8/1992 Agrawal
5,139,547 A 8/1992 Agrawal et al.
5,141,543 A 8/1992 Agrawal et al.
5,341,647 A 8/1994 Koeberle et al.
5,901,579 A * 5/1999 Mahoney et al. ..... 62/646
2006/0075779 A1 4/2006 Higginbotham

FOREIGN PATENT DOCUMENTS

EP 0304355 4/1991
GB 422635 A 1/1935
GB 1376678 12/1974
JP 2000-130926 A 5/2000
JP 3474180 B2 9/2003

* cited by examiner

*Primary Examiner*—Cheryl J Tyler
*Assistant Examiner*—John F Pettitt
(74) *Attorney, Agent, or Firm*—Willard Jones, II

(57) ABSTRACT

A system is set forth to increase the capacity of an LNG-based liquefier in a cryogenic air separation unit wherein, in a low production mode, the nitrogen that is fed to the LNG-based liquefier consists only of at least a portion of the high pressure nitrogen from the distillation column system while in a high production mode, a supplemental compressor is used to boost the pressure of at least a portion of the low pressure nitrogen from the distillation column system to create additional (or replacement) feed to the LNG-based liquefier. A key to the present invention is the supplemental compressor and the associated heat exchange equipment is separate and distinct from the LNG-based liquefier. This allows its purchase to be delayed until a capacity increase is actually needed and thus avoid building an oversized liquefier based on a speculative increase in liquid product demand.

7 Claims, 7 Drawing Sheets

Low Production Mode

High Production Mode

High Production Mode

SYSTEM TO INCREASE CAPACITY OF LNG-BASED LIQUEFIER IN AIR SEPARATION PROCESS

BACKGROUND OF THE INVENTION

The present invention concerns the well known process (hereafter "Process") for the cryogenic separation of an air feed wherein:

(a) the air feed is compressed, cleaned of impurities that will freeze out at cryogenic temperatures such as water and carbon dioxide, and subsequently fed into an cryogenic air separation unit (hereafter "ASU") comprising a main heat exchanger and a distillation column system;

(b) the air feed is cooled (and optionally at least a portion condensed) in the main heat exchanger by indirectly heat exchanging the air feed against at least a portion of the effluent streams from the distillation column system;

(c) the cooled air feed is separated in the distillation column system into effluent streams including a stream enriched in nitrogen and a stream enriched in oxygen (and, optionally, respective streams enriched in the remaining components of the air feed including argon, krypton and xenon); and (d) the distillation column system comprises a higher pressure column and a lower pressure column;

(e) the higher pressure column separates the air feed into effluent streams including a high pressure nitrogen stream withdrawn from the top of the higher pressure column, and a crude liquid oxygen stream withdrawn from the bottom of the higher pressure column and fed to the lower pressure column for further processing;

(f) the lower pressure column separates the crude liquid oxygen stream into effluent streams including an oxygen product stream withdrawn from the bottom of the lower pressure column, and a low pressure nitrogen stream withdrawn from the top of the lower pressure (and often a waste nitrogen stream which is withdrawn from an upper location of the lower pressure column); and (g) the higher pressure column and lower pressure column are thermally linked such that at least a portion of the high pressure nitrogen is condensed in a reboiler/condenser against boiling oxygen-rich liquid that collects in the bottom (or sump) of the lower pressure column and used as reflux for the distillation column system.

More specifically, the present invention concerns the known embodiment of the above-described Process wherein, in order to provide the refrigeration necessary when at least a portion of the product is desired as liquid, refrigeration is extracted from liquefied natural gas (hereafter "LNG") by feeding nitrogen from the distillation column system to an insulated liquefier unit (hereafter "LNG-based liquefier") where it is liquefied. If at least a portion of the liquid product desired is liquid oxygen, at least a portion of the liquefied nitrogen is returned to the distillation column system (or optionally the main heat exchanger). Otherwise, the liquefied nitrogen is withdrawn as product.

Typical of LNG-based liquefiers, the nitrogen is compressed in stages and cooled between stages by indirect heat exchange against LNG. If the compression is performed with a cold-inlet temperature, the LNG will also be used to cool the feed to the compressor as well as the discharge by indirect heat exchange. Examples of LNG-Based liquefiers can be found in GB patent application 1,376,678 and U.S. Pat. Nos. 5,137,558, 5,139,547 and 5,141,543, all further discussed below.

The skilled practitioner will appreciate the contrast between an LNG-based liquefier and the more conventional liquefier where the refrigeration necessary to make liquid product is derived from turbo-expanding either nitrogen or air feed.

An LNG-based liquefier is typically oversized to accommodate a projected increase in demand of liquid products after the initial years of operation. This is particularly true for liquid nitrogen since the demand for liquid nitrogen out of any particularly ASU often grows faster than the demand for liquid oxygen above the base load of liquid oxygen for which the plant is designed. A problem with this oversizing approach however is the incremental capital cost incurred does not begin to pay off until the projected demand increase is actually realized (if at all). Furthermore, capital costs are particularly sensitive for LNG-based liquefiers since, as opposed to conventional liquefiers which are typically located near the customers of the liquid products, LNG-based liquefiers must be located near an LNG receiving terminal and thus incur a product transportation cost penalty.

To address this problem, the present invention is a system to increase the capacity of the LNG-based liquefier comprising a supplemental compressor that is separate and distinct from the auxiliary compressor(s) contained in the LNG-based liquefier. This allows the supplemental compressor and the associated heat exchange equipment to be purchased and installed when the projected demand increase is actually realized, if at all. In this fashion, the incremental capital that would have otherwise been spent on oversizing the LNG-based liquefier from the start does not get spent until it is actually needed. Another benefit of the present invention is that the capacity increase is primarily directly toward the ability to produce liquid nitrogen which, as noted above, will often have a demand that grows faster than the demand for the liquid oxygen from the plant.

The skilled practitioner will appreciate that, as an alternative to the present invention, the capacity of an LNG-based liquefier can be increased by adding a dense fluid expander. However, only modest capacity increases can be achieved in this manner.

GB patent application 1,376,678 (hereafter "GB '678") teaches the very basic concept of how LNG refrigeration may be used to liquefy a nitrogen stream. The LNG is first pumped to the desired delivery pressure then directed to a heat exchanger. The warm nitrogen gas is cooled in said heat exchanger then compressed in several stages. After each stage of compression, the now warmer nitrogen is returned to the heat exchanger and cooled again. After the final stage of compression the nitrogen is cooled then reduced in pressure across a valve and liquid is produced. When the stream is reduced in pressure, some vapor is generated which is recycled to the appropriate stage of compression.

GB '678 teaches many important fundamental principles. First, the LNG is not sufficiently cold to liquefy a low-pressure nitrogen gas. In fact, if the LNG were to be vaporized at atmospheric pressure, the boiling temperature would be typically above −260° F., and the nitrogen would need to be compressed to at least 15.5 bara in order to condense. If the LNG vaporization pressure is increased, so too will the required nitrogen pressure be increased. Therefore, multiple stages of nitrogen compression are required, and LNG can be used to provide cooling for the compressor intercooler and aftercooler. Second, because the LNG temperature is relatively warm compared to the normal boiling point of nitrogen (which is approximately −320° F.), flash gas is generated when the liquefied nitrogen is reduced in pressure. This flash gas must be recycled and recompressed.

U.S. Pat. No. 3,886,758 (hereafter "U.S. '758") discloses a method wherein a nitrogen gas stream is compressed to a pressure of about 15 bara then cooled and condensed by heat exchange against vaporizing LNG. The nitrogen gas stream originates from the top of the lower pressure column of a double-column cycle or from the top of the sole column of a single-column cycle. Some of the condensed liquid nitrogen, which was produced by heat exchange with vaporizing LNG, is returned to the top of the distillation column that produced the gaseous nitrogen. The refrigeration that is supplied by the liquid nitrogen is transformed in the distillation column to produce the oxygen product as a liquid. The portion of condensed liquid nitrogen that is not returned to the distillation column is directed to storage as product liquid nitrogen.

EP 0,304,355 (hereafter "EP '355") teaches the use of an inert gas recycle such as nitrogen or argon to act as a medium to transfer refrigeration from the LNG to the air separation plant. In this scheme, the high pressure inert gas stream is liquefied against vaporizing LNG then used to cool medium pressure streams from the air separation unit (ASU). One of the ASU streams, after cooling, is cold compressed, liquefied and returned to the ASU as refrigerant. The motivation here is to maintain the streams in the same heat exchanger as the LNG at a higher pressure than the LNG. This is done to assure that LNG cannot leak into the nitrogen streams, i.e. to ensure that methane cannot be transported into the ASU with the liquefied return nitrogen. The authors also assert that the bulk of the refrigeration needed for the ASU is blown as reflux liquid into a rectifying column.

U.S. Pat. Nos. 5,137,558, 5,139,547, and 5,141,543 (hereafter "U.S. '558", "U.S. '547", and "U.S. '543" respectively) provide a good survey of the prior art up to 1990. These three documents also teach the state-of-the-art at that time. In all three of these documents, the nitrogen feed to the liquefier is made up of lower pressure and higher pressure nitrogen streams from the ASU. The lower pressure nitrogen stream originates from the lower pressure column; the higher pressure nitrogen stream originates from the higher pressure column. No direction is given as to the ratio of the lower pressure to higher pressure nitrogen streams.

There is little new art in the literature since the early 90's because the majority of applications for recovery of refrigeration from LNG (LNG receiving terminals) were filled and new terminals were not commonly being built. Recently, there has been resurgence in interest in new LNG receiving terminals and therefore the potential to recover refrigeration from LNG.

BRIEF SUMMARY OF THE INVENTION

The present invention relates to a cryogenic air separation unit which utilizes an LNG-based liquefier to provide the refrigeration necessary when at least a portion of the product is desired as liquid. The present invention is a system to increase the capacity of the LNG-based liquefier wherein, in a low production mode, the nitrogen that is fed to the LNG-based liquefier consists only of at least a portion of the high pressure nitrogen from the distillation column system while in a high production mode, a supplemental compressor is used to boost the pressure of at least a portion of the low pressure nitrogen from the distillation column system to create additional (or replacement) feed to the LNG-based liquefier. A key to the present invention is the supplemental compressor is separate and distinct from the LNG-based liquefier. This allows its purchase to be delayed until a capacity increase is actually needed and thus avoid building an oversized liquefier based on a speculative increase in liquid product demand.

DETAILED DESCRIPTION OF THE INVENTION

The present invention is best understood when read in connection with the drawings.

Figure 1A:
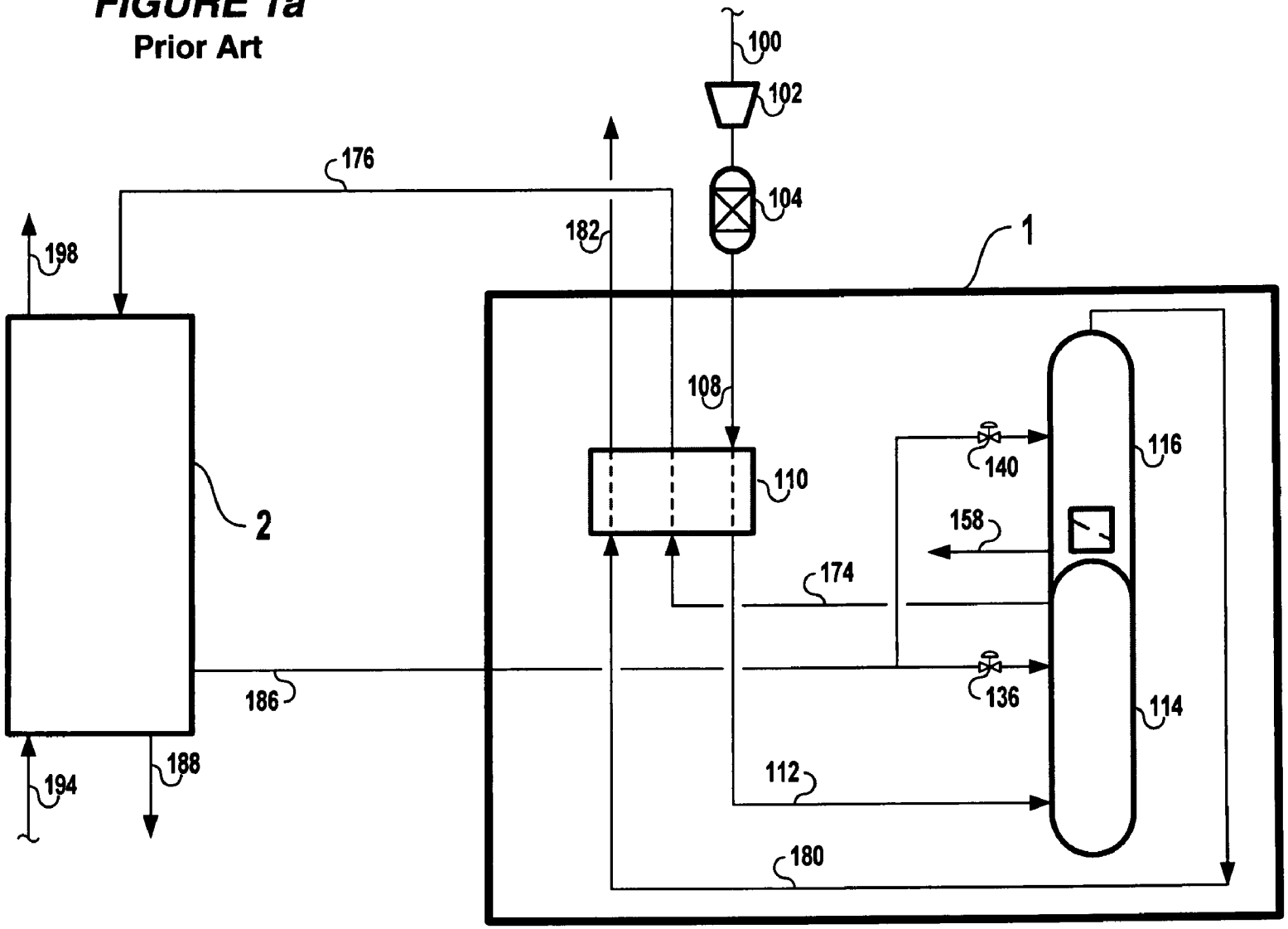
FIGURE 1a Prior Art
FIG. 1*a* is a schematic diagram showing one embodiment of the prior art to which the system of the present invention pertains.

FIG. 1*a* is a schematic diagram showing one embodiment of the prior art to which the system of the present invention pertains. Referring now to FIG. 1*a*, the facility includes an LNG-based liquefier (2) and a cryogenic ASU (1). In this example, the cryogenic ASU includes a higher pressure column (114), lower pressure column (116), and main exchanger (110). Feed air 100 is compressed in 102 and dried in 104 to produce stream 108. Stream 108 is cooled in main exchanger 110 against returning gaseous product streams, to produce cooled air feed 112. Stream 112 is distilled in the double column system to produce liquid oxygen 158, high pressure nitrogen gas (stream 174) and low pressure nitrogen gas (stream 180). The nitrogen gases 174 and 180 are warmed in main exchanger 110 to produce streams 176 and 182. Stream 182 is ultimately rejected to the atmosphere. Stream 176 is processed in the LNG-based liquefier (2) to create liquefied nitrogen product stream 188 and liquid nitrogen refrigerant stream 186. Liquid nitrogen refrigerant stream 186 is introduced into the distillation columns through valves 136 and 140. Refrigeration for LNG-based liquefier is provided from LNG stream 194, which is vaporized and heated to produce stream 198. In FIG. 1*a*, the only nitrogen feed to the LNG-based liquefier is stream 176, which originates from the higher pressure column 114.

Figure 1B:
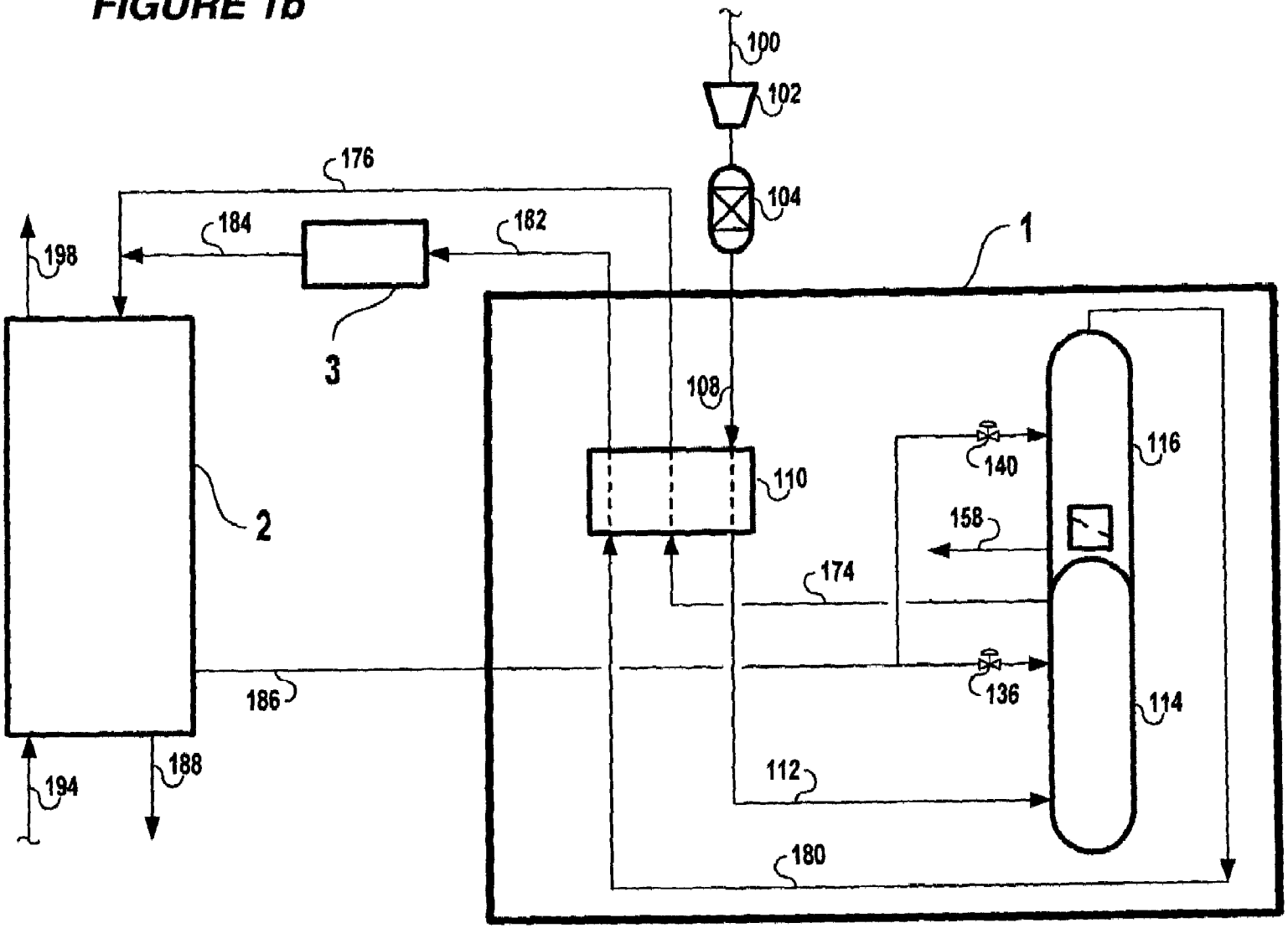
FIG. 1*b* is a schematic diagram showing the basic concept of the present invention in relation to FIG. 1*a*.

FIG. 1*b* is a schematic diagram showing the basic concept of the present invention in relation to FIG. 1*a*. Referring now to FIG. 1*b*, feed air 100 is compressed in 102 and dried in 104 to produce stream 108. Stream 108 is cooled in main exchanger 110 against returning gaseous product streams, to produce cooled air feed 112. Stream 112 is distilled in the double column system to produce liquid oxygen 158, high pressure nitrogen gas (stream 174) and low pressure nitrogen gas (stream 180). The nitrogen gases 174 and 180 are warmed in main exchanger 110 to produce streams 176 and 182. Stream 182 is transformed utilizing a supplemental compressor and the associated heat exchange equipment (referred to hereunder as the "supplemental processing unit" which is depicted as unit 3 in FIG. 1*a*) to become stream 184, then mixed with stream 176, to form a feed to the LNG-based liquefier (2). Liquefied nitrogen product stream 188 and liquid nitrogen refrigerant stream 186 are produced within the LNG-based liquefier. Liquid nitrogen refrigerant stream 186 is introduced into the distillation columns through valves 136 and 140. In contrast to FIG. 1*a*, the source of the nitrogen feed to the LNG-based liquefier leaves the ASU as two streams, 182 and 176.

As noted above, the term supplemental processing unit as used hereunder means the present invention's supplemental compressor and the associated heat exchange equipment. It should be noted however that the term does not necessarily mean the supplemental compressor and the associated heat exchange equipment are contained in a single physical unit. The exact nature of the supplemental processing unit (3) is described in detail with reference to the embodiments of the invention depicted in FIGS. 3*b* and 3*c*.

Operation of FIG. 1*b* where, similar as shown in FIG. 1*a*, stream 182 is vented and not fed the supplemental processing unit (3), is preferred when the ratio of liquid nitrogen product to liquid oxygen product (stream 188/stream 158) is relatively low and hereafter is referred to as "low production mode". When operating in this mode, it is appropriate to extract all of the nitrogen to be liquefied from the higher pressure column. Operation as shown in FIG. 1*b*, hereafter referred to as "high production mode" is preferred when the ratio of liquid nitrogen product to liquid oxygen product (stream 188/stream 158) is relatively high. In such a case, so much nitrogen needs to be liquefied that it is appropriate to extract the nitrogen to be liquefied from both the higher pressure column and lower pressure column.

In FIG. 1*b*, the supplemental processing unit (3) is inserted to transform the state of stream 184 relative to stream 182 so that it may be mixed with stream 176 prior to introduction to the LNG-based liquefier. By doing so, the design and operation of the LNG-based liquefier may be similar in both high and low production modes. In fact, the design of the LNG-based liquefier can be exactly the same and the equipment simply operated at "turn-down" in the low production mode.

Figure 2:
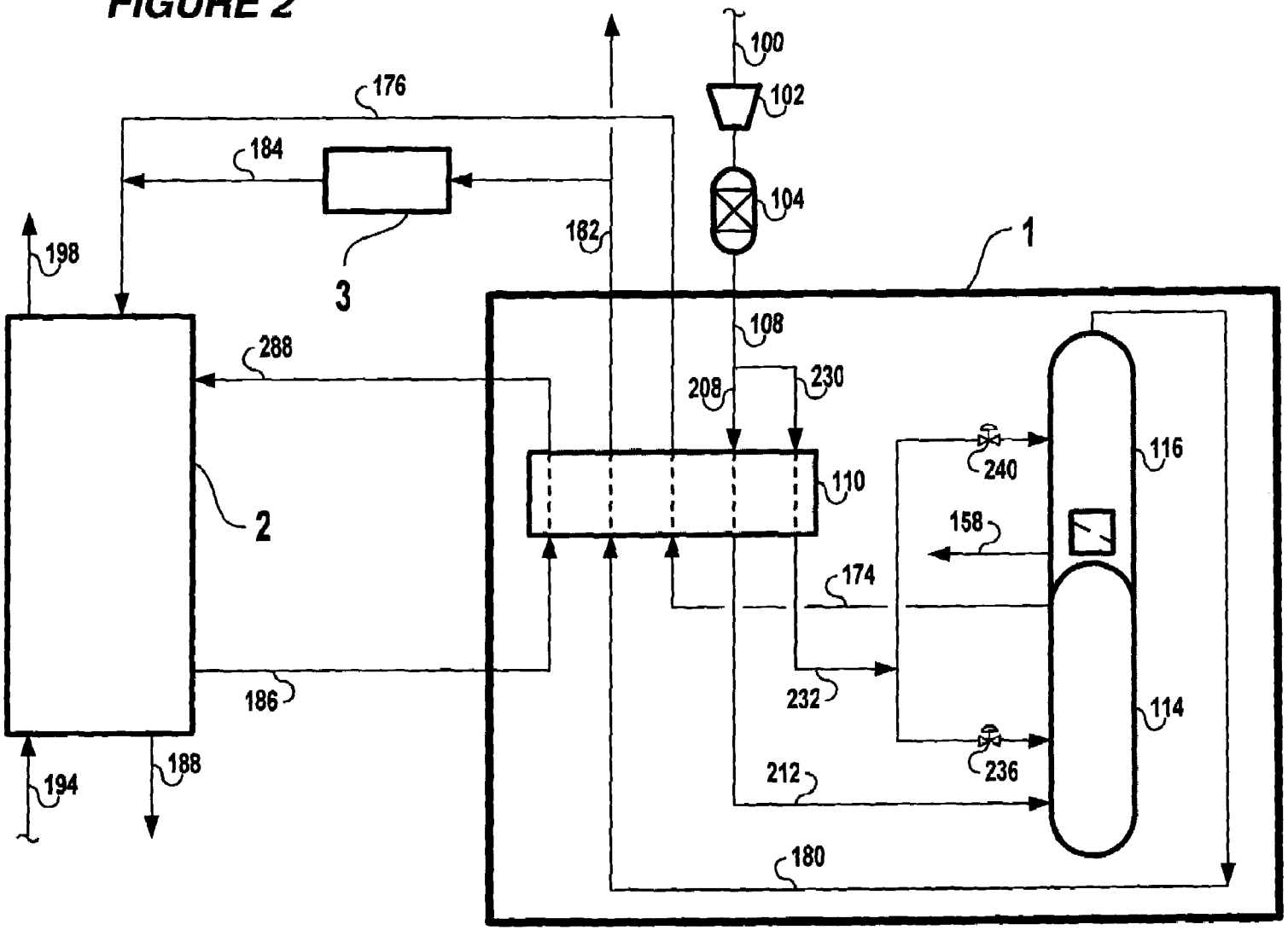
FIG. 2 is a schematic diagram identical to FIG. 1*b* in terms of showing the basic concept of the present invention, but differs slightly with respect to the configuration between the LNG-based liquefier (2) and the ASU (1).

FIG. 2 is a schematic diagram identical to FIG. 1*b* in terms of showing the basic concept of the present invention, but differs slightly with respect to the configuration between the LNG-based liquefier (2) and the ASU (1). In particular, whereas liquefied nitrogen stream 186 is fed to the distillation column system in FIG. 1*b*, stream 186 is fed to the main heat exchanger in FIG. 2. Referring now to FIG. 2, feed air 100 is compressed in 102 and dried in 104 to produce stream 108. Stream 108 is split into a first portion (208) and a second portion (230). Stream 208 is cooled in 110 against returning gaseous product streams, to produce cooled air feed 212. Stream 230 is first cooled in 110 against returning gaseous product streams then liquefied to produce stream 232. Liquid air stream 232 is split and is introduced into the distillation columns through valves 236 and 240. Streams 212 and 232 are distilled in the double column system to produce liquid oxygen 158, high pressure nitrogen gas (stream 174) and low pressure nitrogen gas (stream 180). The nitrogen gases 174 and 180 are warmed in the main exchanger 110 to produce streams 176 and 182. Liquid nitrogen refrigerant stream 186 is directed to the main exchanger where it is vaporized by indirect heat exchange with condensing stream 230 to form vapor nitrogen return stream 288. In low production mode, stream 182 is vented and streams 288 and 176 are processed in the LNG-based liquefier to create liquefied nitrogen product stream 188 and liquid nitrogen refrigerant stream 186. In high production mode, stream 182 is transformed in the supplemental processing unit (3) to become stream 184, then mixed with stream 176. The mixed stream, plus stream 288, are processed in the LNG-based liquefier to create liquefied nitrogen product stream 188 and liquid nitrogen refrigerant stream 186.

Figure 3A:
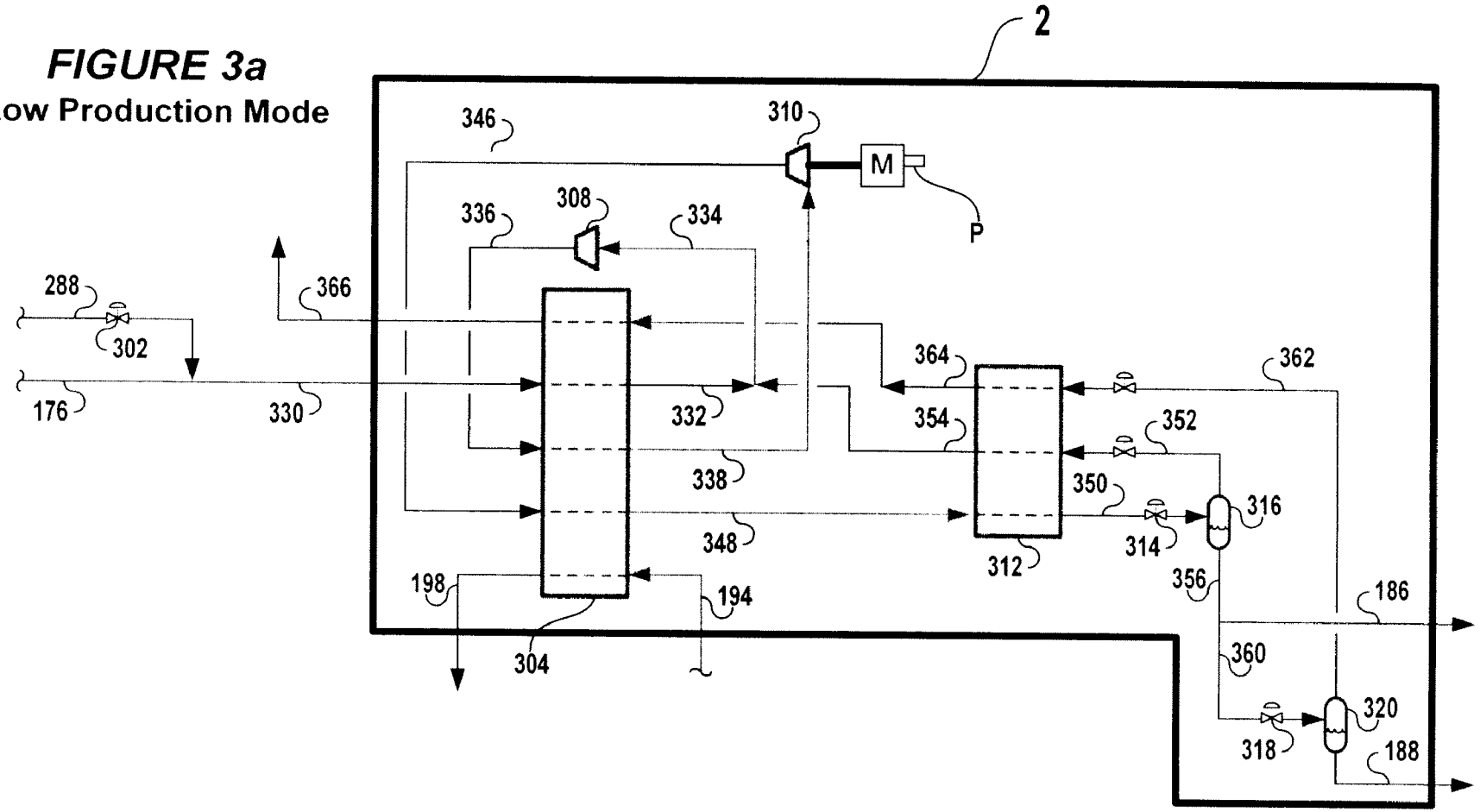
FIG. 3*a* is a schematic diagram showing the detail for one example of an LNG-based liquefier for the flowsheet of FIG. 2.
Figure 3B:
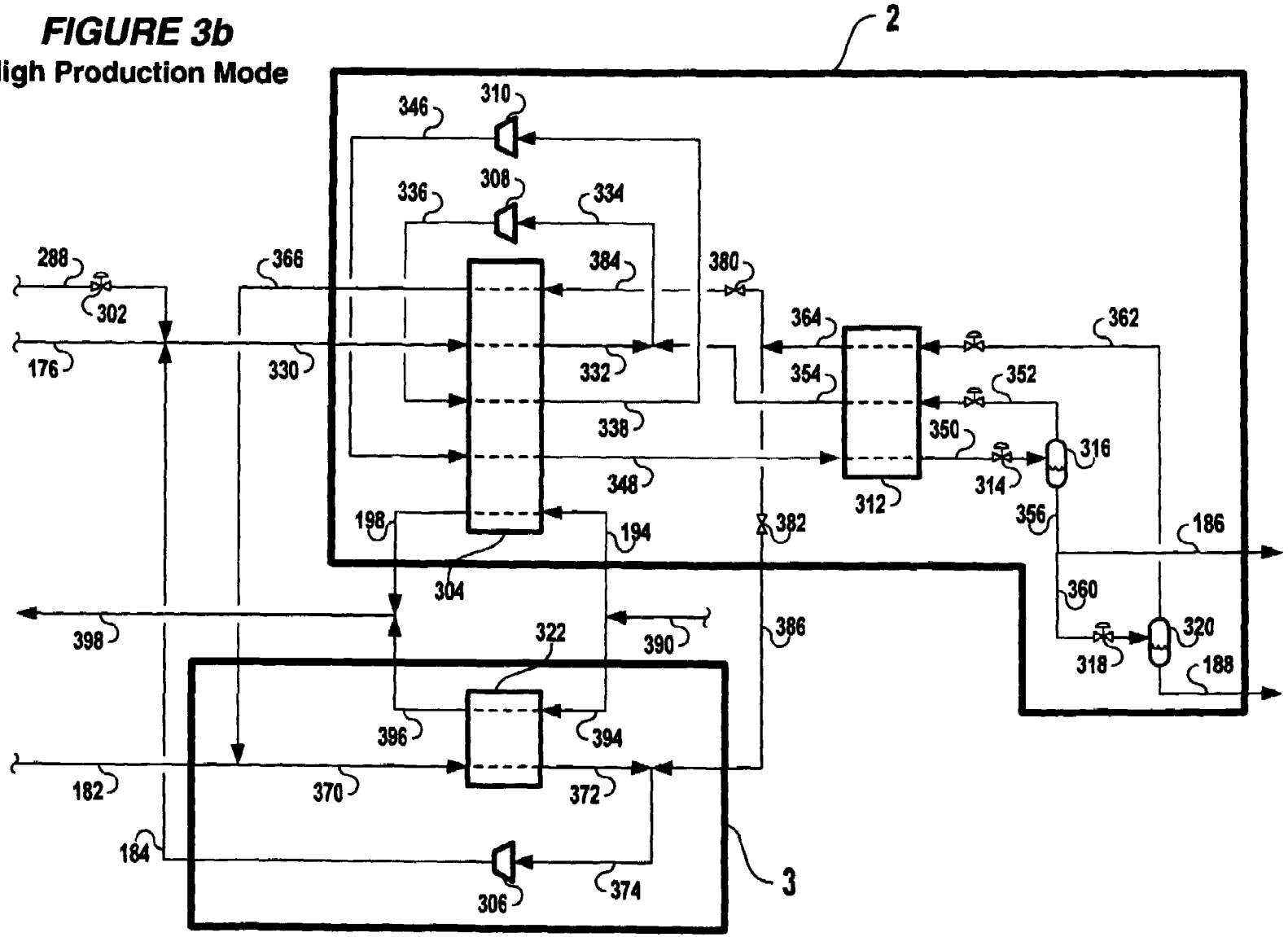
FIG. 3*b* is a schematic diagram showing one embodiment of the present invention, particularly as it relates to the integration between the supplemental processing unit and the LNG-based liquefier of FIG. 3*a*.
Figure 3C:
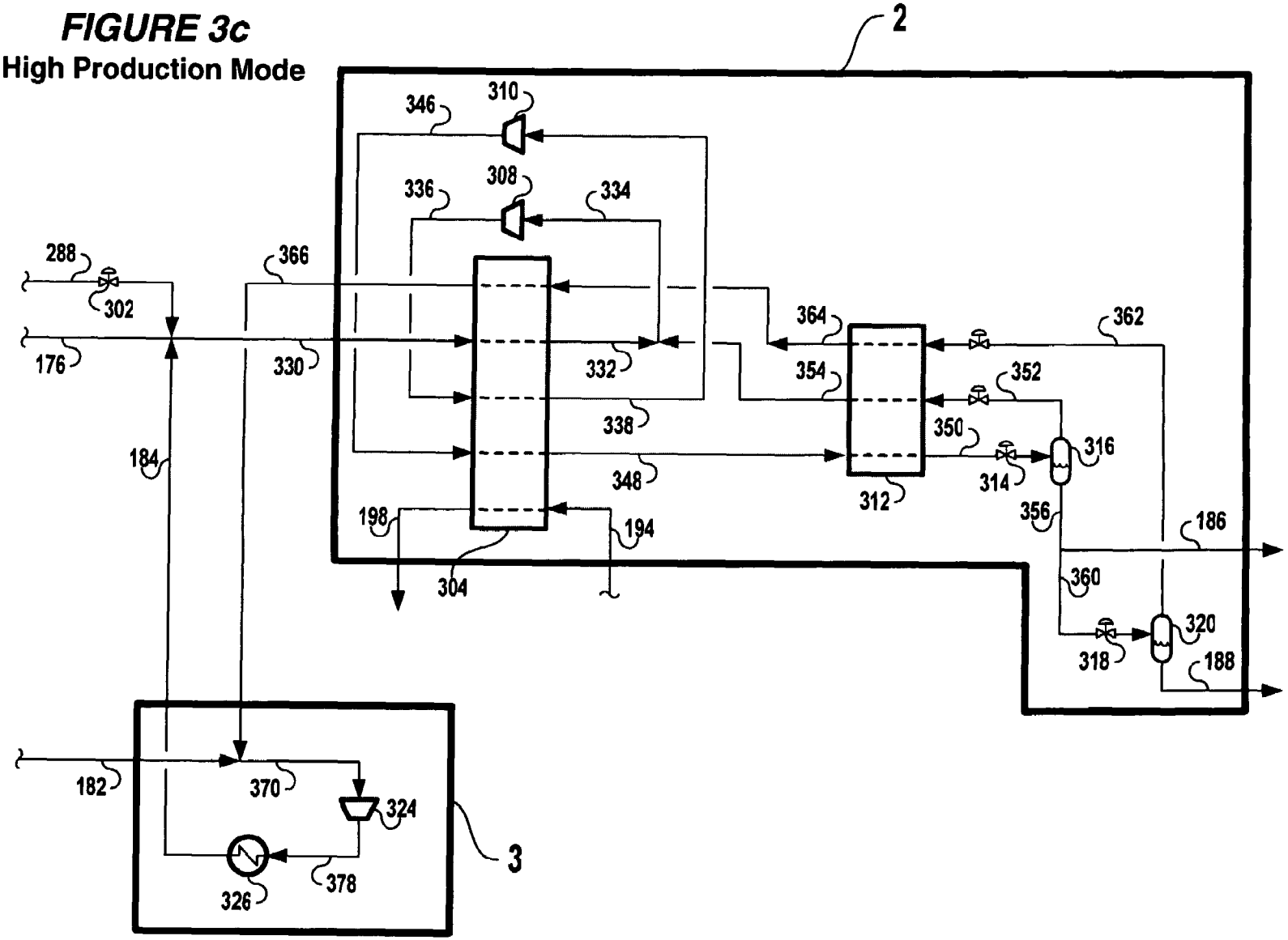
FIG. 3*c* is a schematic diagram of a second embodiment of the present invention, particularly as it relates to the integration between the supplemental processing unit and the LNG-based liquefier of FIG. 3*a*.

The exact nature of the LNG-based liquefier is not the focus of the present invention, however, how the liquefier integrates with the supplemental processing unit (3) is important to understand so an example of an LNG-based liquefier (unit 2 in FIG. 2) is described in FIG. 3*a*. FIG. 3*b* and 3*c* will give examples of the same LNG-based liquefier with inclusion of different embodiments of the supplemental processing unit (3).

Referring to FIG. 3*a*, high pressure nitrogen vapor stream 176 is mixed with vapor nitrogen return stream 288 to form stream 330, which is subsequently cooled in liquefier exchanger 304 to form stream 332. Stream 334 is compressed in a first auxiliary compressor (HP cold compressor 308) to form stream 336. Stream 336 is cooled in liquefier exchanger 304 to make stream 338, then is compressed in a second auxiliary compressor (VHP cold compressor 310) to form stream 346. Stream 346 undergoes cooling and liquefaction in liquefier exchanger 304 to make stream 348.

Liquefied stream 348 is further cooled in cooler 312 to form stream 350. Stream 350 is reduced in pressure across valve 314 and introduced to vessel 316 where the two phase fluid is separated to vapor stream 352 and liquid stream 356. Liquid stream 356 is split into two streams: stream 360 and stream 186, which constitutes the liquid nitrogen refrigerant stream that is directed to the cryogenic ASU. Stream 360 is reduced in pressure across valve 318 and introduced to vessel 320 where the two phase fluid is separated to vapor stream 362 and liquid nitrogen product stream 188. Vapor streams 362 and 352 are warmed in cooler 312 to form streams 364 and 354, respectively. Stream 364 is further warmed in exchanger 304 to form gaseous nitrogen vent stream 366 from the LNG-based liquefier.

Refrigeration for the LNG-based liquefier is supplied by LNG stream 194, which is vaporized and or warmed in liquefier exchanger 304 to form stream 198.

In the strictest sense, the terms "vaporized" and "condensed" applies to streams that are below their critical pressure. Often, the streams 346 (the highest pressure nitrogen stream) and 194 (the LNG supply) are at pressures greater than critical. It is understood that these streams do not actually condense or vaporize. Rather they undergo a change of state characterized by a high degree heat capacity. One of normal skill in the art will appreciate the similarities between possessing a high degree of heat capacity (at supercritical conditions) and possessing a latent heat (at subcritical conditions).

Referring now to FIG. 3*b*, in high production mode of operation, lower pressure nitrogen stream 182 is an additional source of nitrogen that ultimately needs to be liquefied. Per the present invention, the supplemental processing unit (3) has been added to transform low pressure nitrogen stream 182 into a higher pressure nitrogen stream 184. Stream 182 is combined with warm, low pressure gaseous nitrogen vent stream 366 to form stream 370. Stream 370 is cooled in pre-cooling heat exchanger 322 to produce cooled nitrogen stream 372. Stream 372 is mixed with cold, low pressure gaseous nitrogen vent stream 386 from the LNG-based liquefier to form stream 374. Stream 374 is compressed cold in the supplemental compressor (LP compressor 306) to form stream 184, then mixed with high pressure liquefier feed streams 288 and 176 to form stream 330. The refrigeration for cooling stream 370 is provided by LNG stream 394, which is vaporized and/or warmed in precooling heat exchanger 322 to form stream 396.

Operation of LNG-based liquefier (2) in FIG. 3*b* is very similar to that described in FIG. 3*a* with some exceptions. As in FIG. 3*a*, stream 330 is cooled in liquefier exchanger 304 to form stream 332. Stream 334 is compressed in HP cold compressor 308 to form stream 336. Stream 336 is cooled in liquefier exchanger 304 to make stream 338, is compressed in VHP cold compressor 310 to form stream 346. Stream 346 undergoes cooling and liquefaction in liquefier exchanger 304 to make stream 348.

As in FIG. 3*a*, liquefied stream 348 is further cooled in cooler 312 to form stream 350. Stream 350 is reduced in pressure across valve 314 and introduced to vessel 316 where the two phase fluid is separated to vapor stream 352 and liquid stream 356. Liquid stream 356 is split into two streams: stream 360 and stream 186, which constitutes the liquid nitrogen refrigerant stream that is directed to the cryogenic ASU. Stream 360 is reduced in pressure across valve 318 and introduced to vessel 320 where the two phase fluid is separated to vapor stream 362 and liquid nitrogen product stream 188. Vapor streams 362 and 352 are warmed in cooler 312 to form streams 364 and 354, respectively.

FIG. 3*b* is different from FIG. 3*a* in that stream 364, which is a low pressure nitrogen stream, need not be warmed and vented because the supplemental compressor (LP cold compressor 306) exists. There are two possible ways to combine stream 364 with stream 182. In the more thermodynamically preferred case, valve 380 is closed and valve 382 is open. In this event stream 364 flows through valve 382 to become gaseous nitrogen vent stream 386 from the LNG-based liquefier, which is then blended with cold nitrogen feed stream 372. In the less thermodynamically preferred case, valve 380 is open and valve 382 is closed. In this event stream 364 flows through valve 380 to become stream 384, is warmed in heat exchanger 304 to become gaseous nitrogen vent stream 366 from the LNG-based liquefier, then blended with warm nitrogen feed stream 182. The more thermodynamically preferred option (valve 380 closed) would be employed if the cold valves 380 and 382 were incorporated into the liquefier at the design point; the less thermodynamically preferred option (valve 382 closed) would be employed if the inclusion of the supplemental processing unit (3) was executed as a retrofit. In the latter event, valves 380 and 382 might not exist and line 382 would not be present.

Finally in FIG. 3*b*, and as in FIG. 3*a*, refrigeration for the LNG-based liquefier is supplied by LNG stream 194, which is vaporized and or warmed in liquefier exchanger 304 to form stream 198.

As indicated above, the refrigeration to cool the lower pressure nitrogen in precooling heat exchanger 322 is by vaporizing and/or warming LNG stream 394. As an alternative, it is possible to extract a cold nitrogen stream from the cold or intermediate location of the liquefier heat exchanger 304, warm that stream in exchanger 322, then re-cool that stream in exchanger 304. This might be done to eliminate the need to pipe LNG to precooling heat exchanger 322 as shown by stream 394 in FIG. 3*b*. Any suitable stream may be used as the source of the cold nitrogen gas, such as streams 332, 338, or 348.

Referring now to FIG. 3*c*, a simpler supplemental processing unit might be employed. Once again, in high production mode of operation lower pressure nitrogen stream 182 is an additional source of nitrogen that ultimately needs to be liquefied. Per the present invention, the supplemental processing unit (3) has been added to transform low pressure nitrogen stream 182 into a higher pressure nitrogen stream 184. Stream 182 is combined with warm, low pressure nitrogen gaseous nitrogen vent stream 366 from the LNG-based liquefier to form stream 370. Stream 370 is compressed in the supplemental compressor (warm LP compressor 324), then cooled in aftercooler heat exchanger 326 (typically using cooling water or glycol as the cooling medium) to form stream 184. Stream 184 is subsequently mixed with high pressure liquefier feed streams 288 and 176 to form stream 330. The operation of the LNG-Based liquefier is similar to that described in FIG. 3*a*, except stream 366 is not vented.

As noted previously, the supplemental processing unit as depicted as unit (3) in FIGS. 3*b* and 3*c* does not necessarily refer to single physical unit. For example, the supplemental compressor can be contained in a housing with other compressors while the supplemental heat exchanger can be contained in a housing with other heat exchangers. It should also be noted that while the supplemental compressor and heat exchanger operate at above ambient temperature in FIG. 3*c*'s embodiment of the present invention, this equipment operates at below ambient temperatures in FIG. 3*b*'s embodiment and therefore must be insulated.

Example

A worked example has been prepared to demonstrate possible operating conditions associated with the present invention and clarify what is different and common between operating modes. Three cases will be given: Case 1 corresponds to low production mode operation without the supplemental processing unit (3) while Cases 2 and 3 correspond to high production mode operation with the supplemental processing unit (3) in place. For this example, Case 1 is depicted by the LNG-based liquefier (2) of FIG. 3*a*; Cases 2 and 3 are depicted by the LNG-based liquefier (2) and the supplemental processing unit (3) of FIG. 3*b*. For Cases 2 and 3, referring to FIG. 3*b*, valve 380 is closed and valve 382 is open. The cryogenic ASU in shown in greater detail in FIG. 4 and described below.

Figure 4:
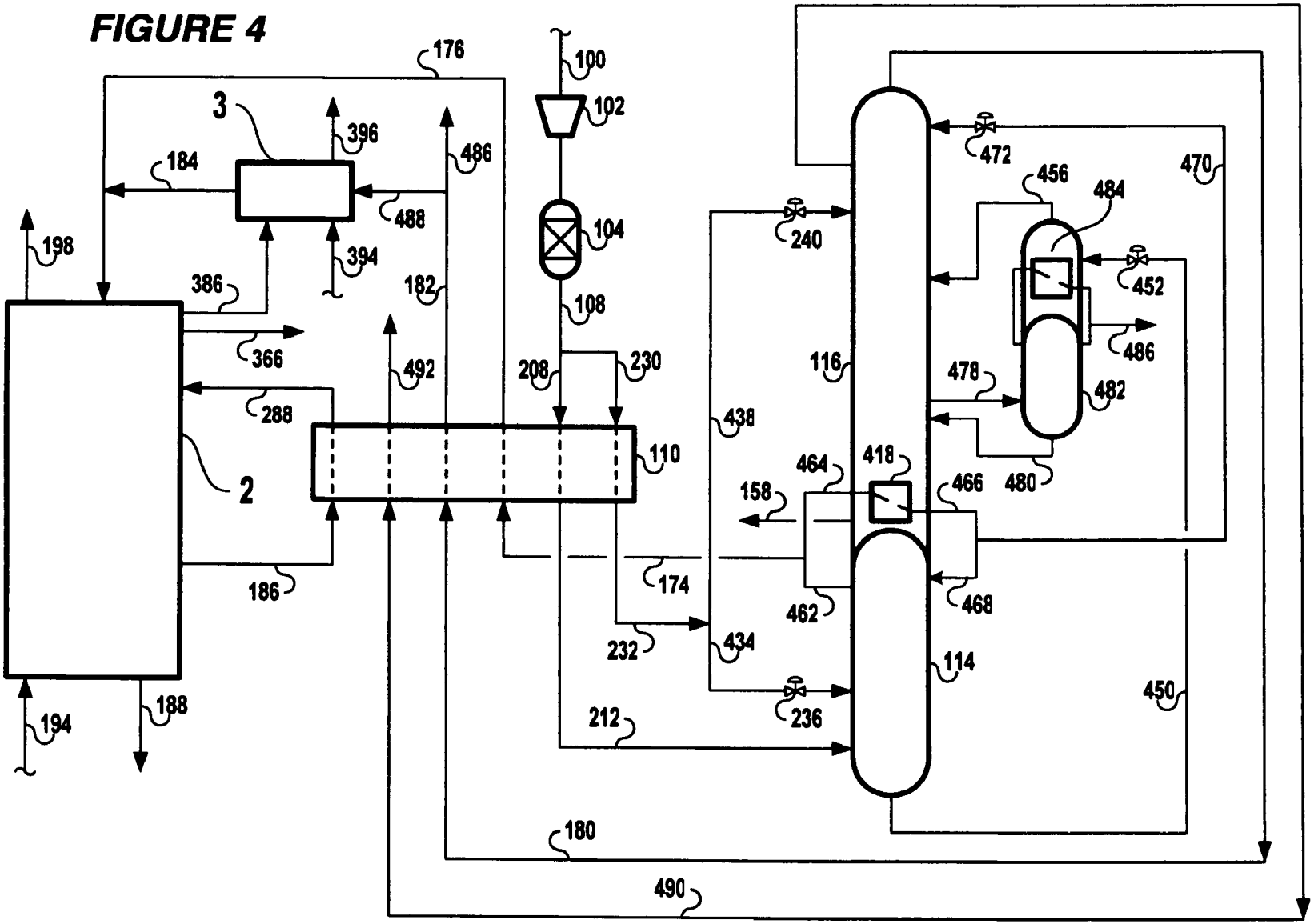
FIG. 4's schematic diagram of the flowsheet that served as the basis for the worked example and includes a more detailed air separation unit.

Referring to FIG. 4, atmospheric air 100 is compressed in the main air compressor 102, purified in adsorbent bed 104 to remove impurities such as carbon dioxide and water, then divided into two fractions: stream 230 and stream 208. Stream 208 is cooled in main heat exchanger 110 to become stream 212, the vapor feed air to the higher pressure column 114. Stream 230 is cooled to a temperature near that of stream 212 then at least partially condensed to form stream 232, then eventually reduced in pressure across valves 236 and 240 and introduced to the higher pressure column 114 and lower pressure column 116. The higher pressure column produces a nitrogen-enriched vapor from the top, stream 462, and an oxygen-enriched stream, 450, from the bottom. Stream 462 is split into stream 174 and stream 464. Stream 174 is warmed in the main heat exchanger then passed, as stream 176 to the LNG-based liquefier (2). Stream 464 is condensed in reboiler-condenser 418 to form stream 466. A portion of stream 466 is returned to the higher pressure column as reflux (stream 468); the remainder, stream 470, is eventually introduced to the lower pressure column as the top feed to that column through valve 472. Oxygen-enriched stream 450 is passed to the argon column's reboiler-condenser 484 through valve 452, and at least partially vaporized to form stream 456, which is directed to the lower pressure column.

The lower pressure column produces the oxygen from the bottom, which is withdrawn as liquid stream 158, and a nitrogen-rich stream, 180, from the top. Nitrogen-rich stream 180 is warmed in main heat exchanger 110 to form stream 182. A waste stream may be removed from the lower pressure column, as stream 490, warmed in the main exchanger and ultimately discharged as stream 492. Boilup for the bottom of the lower pressure column is provided by reboiler-condenser 418. A vapor flow is extracted from the lower pressure column as stream 478 and fed to argon column 482. Argon product is withdrawn from the top of this column as liquid stream 486. Bottom liquid stream 480 is returned to the lower pressure column. The reflux for the argon column is provided by indirect heat exchange with the vaporizing oxygen-enriched stream, which originates from the higher pressure column as stream 450.

Liquid nitrogen refrigerant stream 186 is directed to the main exchanger where it is vaporized by indirect heat exchange with condensing stream 230 to form vapor nitrogen return stream 288.

In low production mode of operation (Case 1) stream 182 is vented to atmosphere from the ASU (as stream 486), stream 366 is vented to atmosphere from the LNG-Based liquefier, and the flow of streams 184 and 386 are zero. In high production mode (Cases 2 and 3) streams 182 (as stream 488) and 386 are passed to the supplemental processing unit, and the flow of stream 366 is zero. For these particular Case 2 and 3 examples, the flow of stream 176 (originating from the higher pressure column) is also zero. That is, in Cases 2 and 3, the entire portion of the high pressure nitrogen 462 from the high pressure column is condensed in reboiler/condenser [418] and used as reflux for the distillation column system such that, as between the boosted pressure nitrogen and the high pressure nitrogen, only the boosted pressure nitrogen is fed to the LNG-based liquefier in high production mode. Although this is not mandatory, it is a typical scenario in high production mode. The distinction between Case 2 and 3 is the liquid nitrogen production in Case 3 is higher.

Cases 1-3 are intended to illustrate how liquid production can be increased. Several balance points can be gleaned from the Table as indicated by Notes 1-5 therein which are explained below:

Note 1: The liquid oxygen production increases by 33% in going from Case 1 to Case 2; liquid oxygen production is the same in Case 2 and 3.

Note 2: The liquid nitrogen production increases 60% in going from Case 1 to Case 2; liquid nitrogen production increases 140% in going from Case 1 to Case 3.

Note 3: The high pressure nitrogen flow is sufficient to meet the liquid nitrogen production requirement in Case 1, but is zero in Cases 2 and 3.

Note 4: Even though the liquid oxygen production is significantly less in Case 1, the air flow to the ASU is roughly the same for all three cases. This is an important feature. When one elects to produce nitrogen from the ASU as high pressure nitrogen then the oxygen recovery declines. As a result, the use of the present invention allows one to use the same air compressor and same Cryogenic ASU for all three cases.

Note 5: Case 1 operates with no LP Compressor (the supplemental processing unit (3) is not needed)

TABLE 1

| | | Case 1 | Case 2 | Case 3 | Notes |
|---|---|---|---|---|---|
| Liquid Oxygen Flow (158) | Nm3/hr | 4,399 | 5,848 | 5,859 | 1 |
| Liquid Nitrogen Product Flow (188) | Nm3/hr | 8340 | 13344 | 20016 | 2 |
| Liquid Argon Flow (486) | Nm3/hr | 121 | 255 | 255 | |
| LP N2 Flow exit ASU (182) | Nm3/hr | 7,469 | 18,956 | 20,438 | |
| Pressure | bara | 1.2 | 1.2 | 1.2 | |
| LP N2 to vent (486) | Nm3/hr | 7,469 | 5,400 | 104 | |
| LP N2 to Unit 3 (488) | Nm3/hr | 0 | 13556 | 20334 | 5 |
| HP N2 Flow exit ASU (176) | Nm3/hr | 9,184 | 0 | 0 | 3 |
| Pressure | bara | 5.2 | n/a | n/a | |
| Vap. N2 refrigerant exit ASU (288) | Nm3/hr | 6,298 | 8,354 | 8,445 | |
| Pressure | bara | 5.2 | 5.2 | 5.2 | |
| LP N2 from Unit 2 to Vent (366) | Nm3/hr | 1562 | 0 | 0 | |
| LP N2 to Unit 3 (386) | Nm3/hr | n/a | 2499 | 3666 | |
| Pressure | bara | n/a | 1.1 | 1.1 | |
| Temperature | C. | n/a | −179.6 | −179.6 | |
| N2 from Unit 3 (184) | Nm3/hr | n/a | 16055 | 24000 | |
| Pressure | bara | n/a | 5.0 | 5.0 | |
| Temperature | C. | n/a | −49.7 | −49.5 | |
| Air Flow (108) | Nm3/hr | 29,831 | 30,598 | 31,923 | 4 |
| Pressure | bara | 5.7 | 5.8 | 5.7 | |
| Liq. N2 refrigerant from Unit 2 (186) | Nm3/hr | 6,298 | 8,354 | 8,445 | |
| Pressure | bara | 5.3 | 5.3 | 5.3 | |
| LNG Supply Flow to Unit 2 (194) | Nm3/hr | 45142 | 64190 | 82291 | |
| LNG Supply Flow to Unit 3 (394) | Nm3/hr | 0 | 5329 | 7994 | |
| Pressure | bara | 76.53 | 75.84 | 75.84 | |
| Temperature | C. | −153.9 | −153.9 | −153.9 | |

In the description of FIG. 4, gaseous nitrogen stream 174 from the high pressure column that is warmed in the main heat exchanger and fed as stream 176 to the liquefier could alternatively be condensed in reboiler-condenser [418]. In this scenario, after being condensed in reboiler-condenser [418], the liquid nitrogen stream 174 would be vaporized and warmed in the main heat exchanger.

Finally, as can be appreciated by one skilled in the art, even though the supplemental compressor of the present invention is separate and distinct from the auxiliary compressor(s) for the LNG-based liquefier, a common machine M (see FIG. 3*a*) could drive both in high production mode. In this scenario, the machine M installed for driving the auxiliary compressor(s) when the plant is built could contain a vacant pinion P for eventually adding the supplemental compressor. Alternately, the auxiliary compressor(s) and the supplemental compressor are driven by separate machines in high production mode.

The invention claimed is:

1. In a process for cryogenic separation of an air feed wherein:

(a) the air feed stream is compressed, cleaned of impurities that will freeze out at cryogenic temperatures and subsequently fed into a cryogenic air separation unit comprising a main heat exchanger and a distillation column system;

(b) the air feed stream is cooled in the main heat exchanger by indirectly heat exchanging the air feed stream against at least a portion of the effluent streams from the distillation column system;

(c) the cooled air feed stream is separated in the distillation column system into a stream enriched in nitrogen and a stream enriched in oxygen and, optionally, respective streams enriched in the remaining components of the air feed including argon, krypton, and xenon;

(d) the distillation column system comprises a higher pressure column and a lower pressure column;

(e) the higher pressure column separates the air feed stream into a high pressure nitrogen stream withdrawn from the top of the higher pressure column, and a crude liquid oxygen stream withdrawn from the bottom of the higher pressure column and fed to the lower pressure column for further processing;

(f) the lower pressure column separates the crude liquid oxygen steam into an oxygen product stream withdrawn from the bottom of the lower pressure column, and a low pressure nitrogen stream withdrawn from the top of the lower pressure; and (g) the higher pressure column and lower pressure column are thermally linked such that at least a portion of the high pressure nitrogen stream is condensed in a reboiler/condenser against boiling oxygen-rich liquid that collects in the bottom or sump of the lower pressure column and the high pressure nitrogen stream is used as reflux for the distillation column system; and (h) in order to provide refrigeration necessary when at least a portion of a product stream is desired as liquid, the refrigeration is extracted from a liquefied natural gas (hereafter "LNG") stream by feeding a first nitrogen stream from the distillation column system to a liquefier unit (hereafter "LNG-based liquefier") where the first nitrogen stream is liquefied by compressing the first nitrogen stream in stages using one or more auxiliary compressors, and cooling between stages by indirect heat exchange against the LNG stream in an auxiliary heat exchanger; and further providing a system to increase the capacity of the LNG-based liquefier comprising a supplemental processing unit, the supplemental processing unit comprising a supplemental pre-cooling heat exchanger that is separate and distinct from the auxiliary heat exchanger of the LNG-based liquefier and a supplemental compressor that is separate and distinct from the auxiliary compressor(s) of the LNG-based liquefier wherein;

(i) in a low production mode, the first nitrogen stream fed to the LNG-based liquefier consists of at least a portion of the high pressure nitrogen stream; and (ii) in a high production mode, the first nitrogen stream fed to the LNG-based liquefier comprises a boosted portion of the low pressure nitrogen stream, wherein the supplemental compressor of the supplemental processing unit is used to boost the pressure of at least a portion of the low pressure nitrogen stream to the pressure of the high pressure nitrogen stream to create the boosted portion of the low pressure nitrogen stream, and wherein, prior to boosting the pressure of the at least a portion of the low pressure nitrogen stream, the at least a portion of the low pressure nitrogen stream is cooled to create a cooled low pressure nitrogen stream by indirect heat exchange against the LNG stream that is fed into the supplemental pre-cooling heat exchanger to provide refrigeration, wherein only low pressure nitrogen is cooled by indirect heat exchange against the LNG stream in the supplemental pre-cooling heat exchanger.

2. The process of claim 1, wherein, in the high production mode, the first nitrogen stream fed to the LNG-based liquefier further comprises at least a portion of the high pressure nitrogen stream.

3. The process of claim 1, wherein, in both the low and high production modes, at least a portion of a liquefied and cooled nitrogen stream exiting the LNG-based liquefier is vaporized by indirect heat exchange against the air feed in the main heat exchanger and then is recycled back to the LNG-based liquefier.

4. The process of claim 1, wherein prior to boosting the cooled low pressure nitrogen stream, the cooled low pressure nitrogen stream is combined with a gaseous nitrogen vent stream from the LNG-based liquefier.

5. The process of claim 1, wherein prior to cooling the low pressure nitrogen stream, the low pressure nitrogen stream is combined with a gaseous nitrogen vent stream from the LNG-based liquefier.

6. The process of claim 1, wherein during the low production mode, the auxiliary compressor(s) are driven by a machine containing a vacant pinion for eventually driving the supplemental compressor.

7. The process of claim 6, wherein during the high production mode, the supplemental compressor is installed on the vacant pinion.

* * * * *